US009178285B2

(12) United States Patent
Hoferer et al.

(10) Patent No.: US 9,178,285 B2
(45) Date of Patent: Nov. 3, 2015

(54) PHASE SHIFT DEVICE AND METHOD

(75) Inventors: Robert Alois Hoferer, Longview, TX (US); Mark Beadle, Longview, TX (US); Jeff Kerpan, Torrance, CA (US); Jason Wrigley, Torrance, CA (US)

(73) Assignee: General Dynamics C4 Systems, Inc., Scottsdale, AZ (US)

( * ) Notice: Subject to any disclaimer, the term of this patent is extended or adjusted under 35 U.S.C. 154(b) by 762 days.

(21) Appl. No.: 13/481,283

(22) Filed: May 25, 2012

(65) Prior Publication Data

US 2013/0314289 A1 Nov. 28, 2013

(51) Int. Cl.

| | |
|---|---|
| ***H01Q 21/24*** | (2006.01) |
| ***H01P 1/18*** | (2006.01) |
| ***H01P 1/213*** | (2006.01) |
| ***H01P 1/165*** | (2006.01) |
| *H01P 5/12* | (2006.01) |
| *H01Q 13/02* | (2006.01) |
| *H01P 1/161* | (2006.01) |
| *H01Q 15/24* | (2006.01) |

(52) U.S. Cl.

CPC ..... *H01Q 21/245* (2013.01); *H01P 1/165* (2013.01); *H01P 1/182* (2013.01); *H01P 1/2131* (2013.01); *H01P 1/161* (2013.01); *H01P 5/12* (2013.01); *H01Q 13/02* (2013.01); *H01Q 15/242* (2013.01)

(58) Field of Classification Search

CPC ..... H01P 1/18; H01P 1/182; H01P 5/18; H01P 5/181; H01P 1/2131; H01P 5/12; H01P 1/161; H01P 1/165; H01Q 13/02; H01Q 15/242; H01Q 21/24; H01Q 21/245

USPC ..... 333/1, 24.1, 117, 137, 157, 159, 21 A

See application file for complete search history.

(56) References Cited

U.S. PATENT DOCUMENTS 4,063,248 A 12/1977 Debski et al.
7,646,263 B1 * 1/2010 Ergene et al. ..... 333/137

FOREIGN PATENT DOCUMENTS

EP 1251578 A2 * 10/2002

* cited by examiner

*Primary Examiner* — Benny Lee
*Assistant Examiner* — Jorge Salazar, Jr.
(74) *Attorney, Agent, or Firm* — Ingrassia, Fisher & Lorenz, PC

(57) ABSTRACT

A phase shift device includes an input quadrature junction for receiving an input EM signal and extracting a first electromagnetic (EM) signal, a second EM signal, a third EM signal, and a fourth EM signal from the input EM signal. Four waveguide arms are operatively connected to the input quadrature junction for respectively conveying the first, second, third, and fourth EM signals therethrough. At least two of the waveguide arms shift the phase of EM signal conveyed therethrough such that two of the first, second, third, and fourth EM signals are phase shifted with respect to the other two of the first, second, third, and fourth EM signals. An output quadrature junction is operatively connected to the waveguide arms for combining the first, second, third, and fourth EM signals. Thus, polarization adjustment may be achieved through rotation of the phase shift device.

13 Claims, 3 Drawing Sheets

PHASE SHIFT DEVICE AND METHOD

BACKGROUND OF THE INVENTION

1. Field of the Invention

The invention relates generally to phase shift devices and methods for use with antennas for transmitting and/or receiving electromagnetic (EM) signals.

2. Description of the Related Art

In satellite communication systems, it is often necessary to adjust the angle of polarization of an EM signal that is transmitted or received. Typically, such an adjustment is achieved by physically rotating an antenna or an entire antenna feed assembly. Such an arrangement is bulky and often cost prohibitive.

As such, there remains an opportunity to adjust the angle of polarization of an EM signal without using large or bulky rotation components.

BRIEF SUMMARY

A phase shift device includes an input quadrature junction configured to receive an input EM signal and extracting a first electromagnetic (EM) signal, a second EM signal, a third EM signal, and a fourth EM signal from the input EM signal. A first waveguide arm is operatively connected to the input quadrature junction to convey the first EM signal therethrough. A second waveguide arm is operatively connected to the input quadrature junction to convey the second EM signal therethrough. A third waveguide arm is operatively connected to the input quadrature junction to convey the third EM signal therethrough. A fourth waveguide arm is operatively connected to the input quadrature junction to convey the fourth signal therethrough. At least two of the waveguide arms shift the phase of EM signal conveyed therethrough such that two of the first, second, third, and fourth EM signals are phase shifted with respect to the other two of the first, second, third, and fourth EM signals. The phase shift device further includes an output quadrature junction operatively connected to the waveguide arms to combine the first, second, third, and fourth EM signals and provide an output EM signal.

BRIEF DESCRIPTION OF THE DRAWINGS

Other advantages of the disclosed subject matter will be readily appreciated, as the same becomes better understood by reference to the following detailed description when considered in connection with the accompanying drawings wherein.

DETAILED DESCRIPTION

Referring to the Figures, wherein like numerals indicate like parts throughout the several views, a phase shift device 10 is shown herein.

Figure 1:
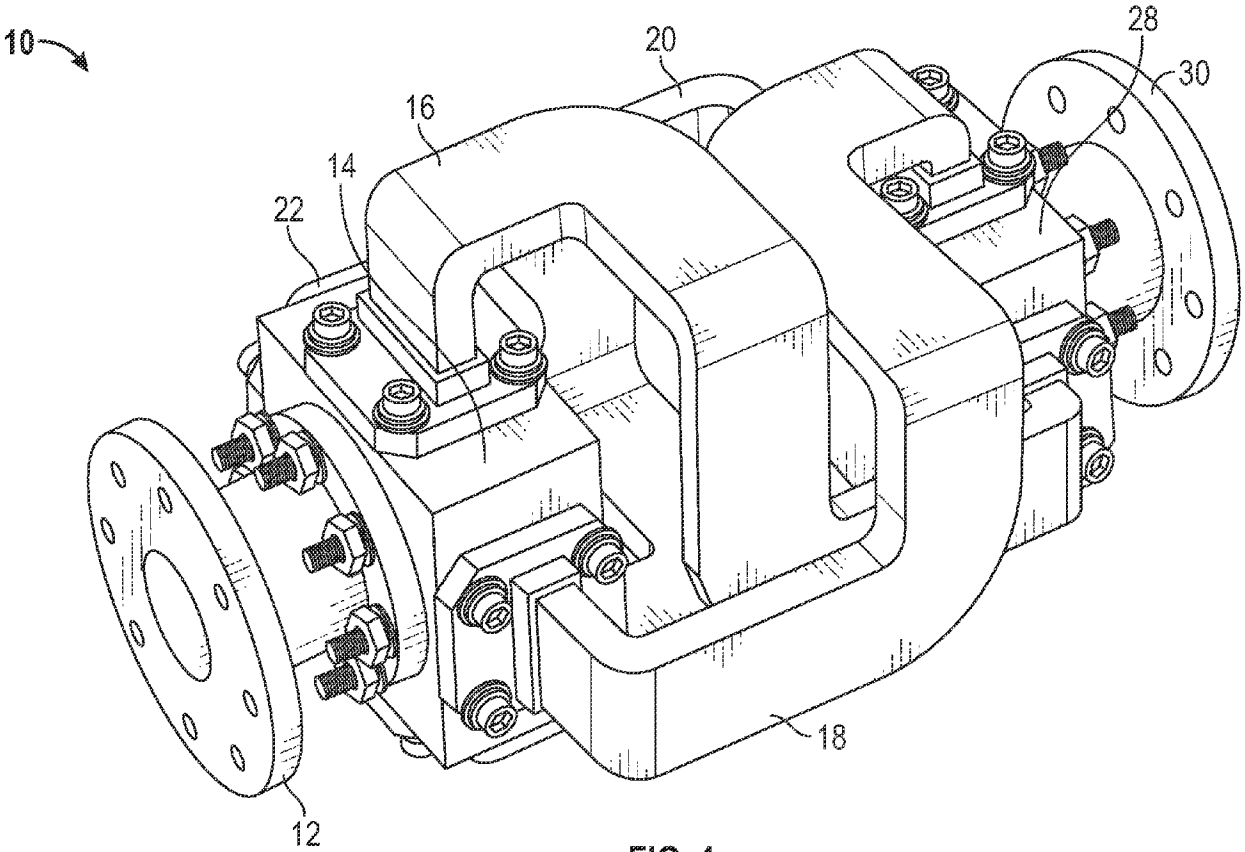
FIG. 1 is perspective view a phase shift device according to one embodiment.

Referring to FIG. 1, a first embodiment of the phase shift device 10 includes an input waveguide 12. The input waveguide 12 receives an input electromagnetic (EM) signal from an external source (not shown) and conveys the input EM signal therethrough. However, the phase shift device 10 described herein may be utilized with a wide variety of EM signals, regardless of their polarization or source.

The input waveguide 12 of the first embodiment is circular. That is, the input waveguide 12 includes a hollow cylinder (not numbered) formed of an electrically conductive material, e.g., a metal. Even more specifically, the input waveguide 12 of the first embodiment includes a pair of flanges (not numbered) disposed on either side of the hollow cylinder. The flanges include a plurality of holes to allow secure connection of the input waveguide 12 to other devices. However, other configurations and embodiments of the input waveguide 12 are recognized by those skilled in the art.

The phase shift device 10 also includes an input quadrature junction 14. The input quadrature junction may alternately be referred to as a power divider, an orthomode transducer, a turnstile, or a power splitter, as recognized by those skilled in the art. The input quadrature junction 14 receives a signal and splits the signal into four other signals. In the illustrated embodiments, the input quadrature junction 14 is electrically connected to the input waveguide 12 for receiving the input EM signal from the input waveguide 12. The input quadrature junction 14 is configured to extract a first EM signal, a second EM signal, a third EM signal, and a fourth EM signal from the input EM signal present at the input waveguide 12.

In the illustrated embodiments, where the input EM signal is linearly polarized, the input quadrature junction 14 produces four components of the linearly polarized input EM signal. More specifically, the input quadrature junction 14 produces two horizontal components of the linearly polarized input EM signal and two vertical components of the linearly polarized input EM signal. The first and third EM signals may be the horizontal components while the second and fourth EM signals may be the vertical components, or vice-versa.

The phase shift device 10 further includes four waveguide arms 16, 18, 20, 22 electrically connected to the input quadrature junction. Specifically, the phase shift device 10 includes a first waveguide arm 16, a second waveguide arm 18, a third waveguide arm 20, and a fourth waveguide arm 22. The first waveguide arm 16 is electrically connected to the input quadrature junction 14 for receiving the first EM signal. The second waveguide arm 18 is operatively connected to the input quadrature junction 14 for receiving the second EM signal. A third waveguide arm 20 is operatively connected to the input quadrature junction 14 for receiving the third EM signal. A fourth waveguide arm 22 is operatively connected to the input quadrature junction 14 for receiving the fourth EM signal.

The waveguide arms 16, 18, 20, 22 of the first embodiment, as shown in FIG. 1, are formed of an electrically conductive material, e.g., a metal. Furthermore, the waveguide arms 16, 18, 20, 22 of the illustrated embodiment are generally hollow and rectangular in shape. That is, the waveguide arms 16, 18, 20, 22 form a cavity (not shown) and have a generally rectangular cross section. However, in other embodiments, other materials and shapes for the waveguide arms 16, 18, 20, 22 may be successfully implemented, as well as other techniques for separating and guiding the EM signals.

For convenience in naming, the first, second, third, and fourth waveguide arms 16, 18, 20, 22 of the illustrated embodiments are connected to the input quadrature junction 14 in circular sequence. As such, the first and third waveguide arms 16, 20 are opposite one another and the second and fourth waveguide arms 18, 22 are also opposite one another. Accordingly, the first and third EM signals, i.e., the horizontal components, are conveyed through the first and third waveguide arms 16, 20 that are opposite the second and fourth waveguide arms 18, 22 that convey the second and fourth EM signals, i.e., the vertical components.

The waveguide arms 16, 18, 20, 22 may serve to shift the phase of the first, second, third, and fourth EM signals. Said another way, the waveguide arms 16, 28, 20, 22 may provide a phase adjustment in some or all of the first, second, third, and fourth EM signals.

In the illustrated embodiments, the physical characteristics (e.g., bends, turns, curves, twists, and/or length) of the waveguide arms 16, 18, 20, 22 provide the phase shifting of the first, second, third, and/or fourth EM signals. Said another way, the waveguide arms 16, 18, 20, 22 provide a "rotation" of the first, second, third, and/or fourth EM signals. In the illustrated embodiments, at least two of the waveguide arms 16, 18, 20, 22 shift the phase of at least two of the first, second, third, and fourth signals. Specifically, two of the first, second, third, and fourth EM signals are phase shifted with respect to the other two of the first, second, third, and fourth EM signals.

The waveguide arms 16, 18, 20, 22 of the illustrated embodiments are configured are configured to shift, i.e., rotate, two of first, second, third, and fourth EM signals by about 180 degrees with respect to the other two of the first, second, third, and fourth EM signals. More specifically, in the illustrated embodiments, the waveguide arms 16, 18, 20, 22 are configured to shift the phase of the first and third EM signals by about 180 degrees with respect to the second and fourth EM signals.

Those skilled in the art will appreciate that precise phase shifts are difficult, if not impossible, to achieve. For example, a "180 degree phase shift" may actually be 178.3 degrees, 184.6 degrees, or some other reasonable value. As such, the phase shifts described herein are simply idealized values and no precise implication should be assumed.

Figure 2:
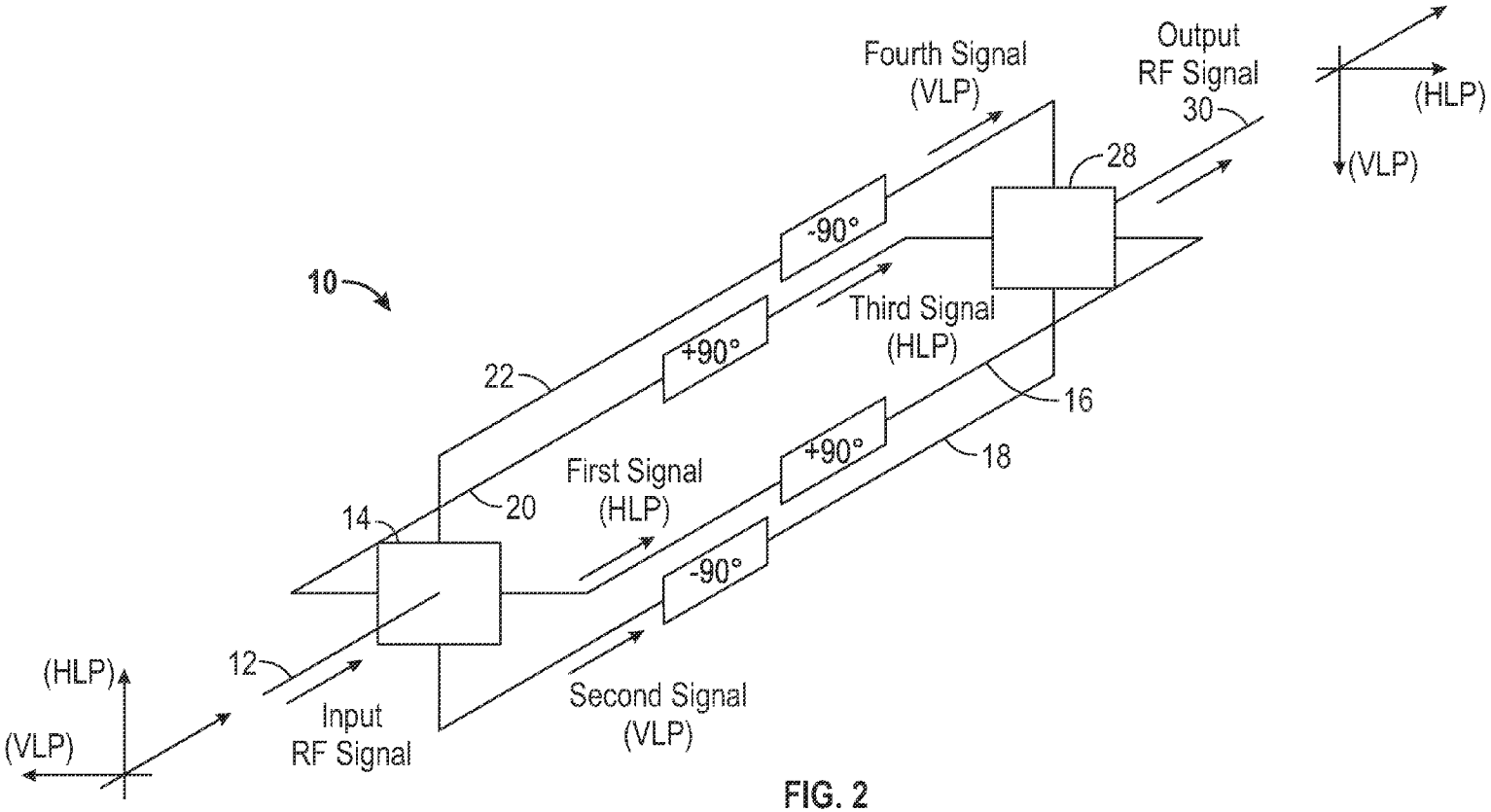
FIG. 2 is block diagram of the phase shift device according to one embodiment.

In the first embodiment, as shown in FIGS. 1 and 2, the first and third waveguide arms 16, 20 are configured to shift the phase of the first and third EM signals by about +90 degrees and the second and fourth waveguide arms 18, 22 are configured to shift the phase of the second and fourth EM signals by about −90 degrees. That is, the first and third waveguide arms 16, 20 shift the first and third EM signals by about 90 degrees in one direction while the second and fourth waveguide arms 18, 22 shift the second and fourth EM signals by about 90 degrees in the opposite direction. As a result, the first and third EM signals are phase shifted by about 180 degrees with respect to the second and fourth EM signals.

Each waveguide arm 16, 18, 20, 22 may include a plurality of phase shift sections 24, 26 to provide different phase shifts on the arm 16, 18, 20, 22. The phase shift sections 24, 26 may be achieved by specific bends, turns, curves, twists, and/or length of the arm 16, 18, 20, 22.

The phase shift device 10 also includes an output quadrature junction 28. The output quadrature junction 28 may alternately be referred to as a power divider, an orthomode transducer, a turnstile, a power splitter, or a power combiner, as recognized by those skilled in the art. The output quadrature junction 28 receives four EM signals and combines those EM signals into a single EM signal. Specifically, in the illustrated embodiments, the output quadrature junction 28 is electrically connected to the waveguide arms 16, 18, 20, 22. The output quadrature junction 28 combines the first, second, third, and fourth EM signals and provides an output EM signal. The output EM signal is linearly polarized and includes two waves with 180 degree relative phase separation.

The phase shift device 10 may also include an output waveguide 30. The output waveguide 30 is electrically connected to the output quadrature junction 28. The output waveguide 30 receives the output EM signal from the output quadrature junction 28 and conveys the output EM signal therethrough. The output waveguide 30 of the first embodiment is circular. That is, the output waveguide 30 includes a hollow cylinder (not numbered) formed of an electrically conductive material, e.g., a metal. Even more specifically, the output waveguide 30 of the first embodiment includes a pair of flanges (not numbered) disposed on either side of the hollow cylinder. The flanges include a plurality of holes to allow secure connection of the output waveguide 30 to other devices. However, other configurations and embodiments of the output waveguide 30 are recognized by those skilled in the art.

Figure 3:
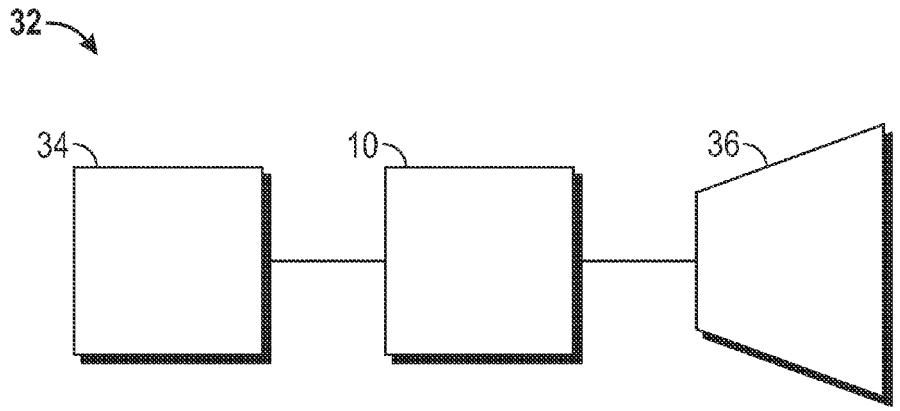
FIG. 3 is a block diagram of an antenna system incorporating the phase shift device.

Referring now to FIG. 3, the phase shift device 10 described herein may be implemented in an antenna system 32. More specifically, the phase shift device 10 may be disposed between an orthomode transducer 34 and a feed horn 36 of an antenna 38. The orthomode transducer 34 may alternatively be referred to as a polarization duplexer and commonly abbreviated as "OMT". The phase shift device 10 used in the antenna system 32 allows for polarization adjustment by aligning the vertically polarized EM waves with a dominant-mode waveguide arm (not shown) of the OMT 34 through the rotation of the phase shift device 10.

Figure 4:
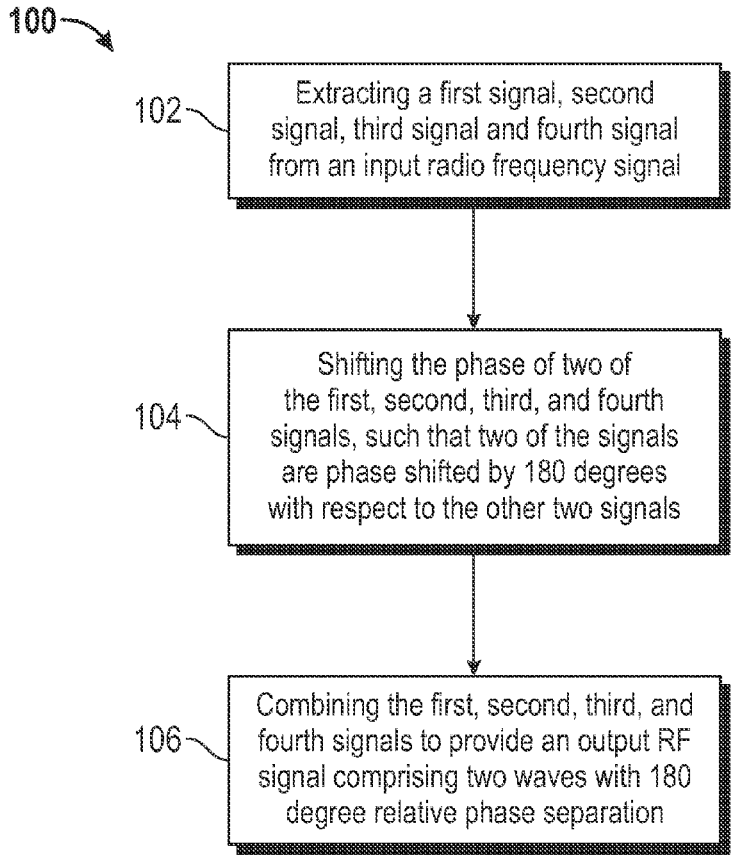
FIG. 4 is a flowchart of a method for phase shifting the waves of an EM signal.

A method 100 for phase shifting the waves of an EM signal is described in conjunction with the phase shift device 10 described above. However, for convenience purposes, portions of the method 100 are described hereafter and with reference to FIG. 4. The method 100 described hereafter may be performed with structures other than the phase shift device 10 described above.

The method 100 includes the step 102 of extracting a first signal, a second signal, a third signal, and a fourth signal from an input electromagnetic (EM) signal. The method further includes the step 104 of shifting the phase of at least two of the first, second, third, and fourth signals, such that two of the signals are phase shifted by 180 degrees with respect to the other two signals. The method 100 also includes the step 106 of combining the first, second, third, and fourth signals to provide an output EM signal comprising two waves with about 180 degree relative phase separation.

Step 104 may be implemented by shifting the phase of the first and third signals by about 180 degrees with respect to the second and fourth signals. In one embodiment, this may be achieved by shifting the phase of the first and third signals by about +90 degrees and shifting the second and fourth signals by about −90 degrees.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A phase shift device comprising:

an input quadrature junction configured to receive an input electromagnetic (EM) signal and extract a first EM signal, a second EM signal, a third EM signal, and a fourth EM signal from the input EM signal;

a first waveguide arm operatively connected to said input quadrature junction to convey the first EM signal therethrough;

a second waveguide arm operatively connected to said input quadrature junction to convey the second EM signal therethrough;

a third waveguide arm operatively connected to said input quadrature junction to convey the third EM signal therethrough;

a fourth waveguide arm operatively connected to said input quadrature junction to convey the fourth signal therethrough;

wherein at least two of said first, second, third and fourth waveguide arms are configured to shift the phase of the first and third EM signals conveyed therethrough such that the first and third EM signals are phase shifted by about 180 degrees with respect to the second and fourth EM signals; and an output quadrature junction operatively connected to said first, second, third, and fourth waveguide arms to combine the first, second, third, and fourth EM signals and provide an output EM signal.

2. A phase shift device as set forth in claim 1 wherein said at least two of said first, second, third and fourth waveguide arms include said first and third waveguide arms which are configured to shift the phase of the input EM signal by about +90 degrees and said second and fourth waveguide arms which are configured to shift the phase of the input EM signal by about −90 degrees such that the first and third EM signals are phase shifted by the about 180 degrees from the second and fourth EM signals.

3. A phase shift device as set forth in claim 1 wherein said at least two of said first, second, third and fourth waveguide arms include said first and third waveguide arms which are configured to shift the phase of the of the respective first and third EM signals conveyed therethrough by about +90 degrees and said second and fourth waveguide arms which are configured to shift the phase of the of the respective second and fourth EM signals conveyed therethrough by about −90 degrees, thus creating the about 180 degrees phase shift between the first and third EM signals and the second and fourth EM signals.

4. A phase shift device as set forth in claim 1 further comprising an input waveguide operatively connected to said input quadrature junction configured to receive the input EM signal from an external source and conveying the input EM signal therethrough.

5. A phase shift device as set forth in claim 4 wherein said input waveguide is circular.

6. A phase shift device as set forth in claim 1 further comprising an output waveguide operatively connected to said output quadrature junction to receive the output EM signal from said output quadrature junction and convey the output EM signal therethrough.

7. A phase shift device as set forth in claim 6 wherein said output waveguide is circular.

8. A method comprising:

extracting a first electromagnetic (EM) signal, a second EM signal, a third EM signal, and a fourth EM signal from an input EM signal;

shifting the phase of the first and the third EM signals by about 180 degrees with respect to the second and fourth EM signals; and combining the first, second, third, and fourth EM signals to provide an output EM signal.

9. A method as set forth in claim 8 wherein shifting the phase of the first and third EM signals by about 180 degrees with respect to the second and fourth EM signals comprises shifting the phase of the first and third EM signals by about 180 degrees with respect to the input EM signal.

10. A method as set forth in claim 8 wherein shifting the phase of the first and third EM signals by 180 degrees with respect to the second and fourth EM signals comprises shifting the phase of the first and third EM signals by about +90 degrees with respect to the input EM signal and shifting the second and fourth EM signals by about −90 degrees with respect to the input EM signal.

11. An antenna system comprising:

an antenna having a feed horn;

an orthomode transducer; and a phase shift device disposed between said antenna and said orthomode transducer, said phase shift device including:

an input quadrature junction configured to receive an input electromagnetic (EM) signal and extract a first EM signal, a second EM signal, a third EM signal, and a fourth EM signal from the input EM signal, a first waveguide arm operatively connected to said input quadrature junction to convey the first EM signal therethrough, a second waveguide arm operatively connected to said input quadrature junction to convey the second EM signal therethrough, a third waveguide arm operatively connected to said input quadrature junction to convey the third EM signal therethrough, a fourth waveguide arm operatively connected to said input quadrature junction to convey the fourth signal therethrough, wherein at least two of said first, second, third and fourth waveguide arms are configured to shift the phase of the first and third EM signals conveyed therethrough such that the first and third EM signals are phase shifted by about 180 degrees with respect to the second and fourth EM signals, and an output quadrature junction operatively connected to said first, second, third, and fourth waveguide arms to combine the first, second, third, and fourth EM signals.

12. An antenna system as set forth in claim 11 wherein said at least two of said waveguide arms include said first and third waveguide arms which are configured to shift the phase of the input EM signal by about +90 degrees and said second and fourth waveguide arms which are configured to shift the phase of the input EM signal by about −90 degrees such that the first and third EM signals are phase shifted by the about 180 degrees from the second and fourth EM signals.

13. An antenna system as set forth in claim 11 wherein said at least two of said waveguide arms include said first and third waveguide arms which are configured to shift the phase of the of the respective first and third signals conveyed therethrough by about +90 degrees and said second and fourth waveguide arms which are configured to shift the phase of the of the respective second and fourth signals conveyed therethrough by about −90 degrees, thus creating the about 180 degrees phase shift between the first and third EM signals and the second and fourth EM signals.

* * * * *